US005975325A

United States Patent [19]

Wallace

[11] Patent Number: 5,975,325

[45] Date of Patent: Nov. 2, 1999

[54] FOOD ENCLOSURE

[76] Inventor: Allan Wallace, 425 Ena Rd., Apt. 101-B, Honolulu, Hi. 96815

[21] Appl. No.: 08/999,338

[22] Filed: Dec. 29, 1997

[51] Int. Cl.[6] ..... B65D 30/10; A45C 11/00

[52] U.S. Cl. ..... 220/9.4; 206/577

[58] Field of Search ..... 220/9.2, 9–3, 9.4, 220/6, 23.87; 229/199; 224/432, 42.34; 248/166, 188.6, 439; 5/155, 177, 179, 180; 135/128, 139, 141, 143, 145, 157; 108/123, 126, 160; 190/903; 206/577, 576

[56] References Cited

U.S. PATENT DOCUMENTS

| | | | |
|---|---|---|---|
| 976,950 | 11/1910 | Tyner . | |
| 1,084,221 | 1/1914 | Mohr | 220/6 |
| 1,546,020 | 7/1925 | Nesbitt . | |
| 1,624,212 | 4/1927 | Butcher | 220/9.3 |
| 2,444,511 | 7/1948 | Kaufmann | 190/903 X |
| 2,688,420 | 9/1954 | Bishop et al. | 220/23.87 X |
| 2,897,999 | 8/1959 | Bishop | 220/9.4 X |
| 3,483,954 | 12/1969 | Michalski | 206/576 |
| 3,744,500 | 7/1973 | Briggs . | |
| 4,036,361 | 7/1977 | Jacobson et a. | 220/6 X |
| 4,685,483 | 8/1987 | Balazs . | |
| 4,903,853 | 2/1990 | Lin | 220/6 |

FOREIGN PATENT DOCUMENTS

| | | | |
|---|---|---|---|
| 1453466 | 9/1966 | France | 220/9.2 |

*Primary Examiner*—Allan N. Shoap
*Assistant Examiner*—Joe Merek
*Attorney, Agent, or Firm*—Michael I. Kroll

[57] ABSTRACT

A food enclosure (10) comprising a box-shaped framework (12) having two open sides, two open ends, an open top and an open bottom, which can be placed upon a horizontal support surface (14) over food (16) and beverages (18). A skirt (20) extends about the two open sides and the two open ends of the box-shaped framework (12). A canopy (22) is secured onto the open top of the box-shaped framework (12) to protect the food (16) and beverages (18) therein.

16 Claims, 4 Drawing Sheets

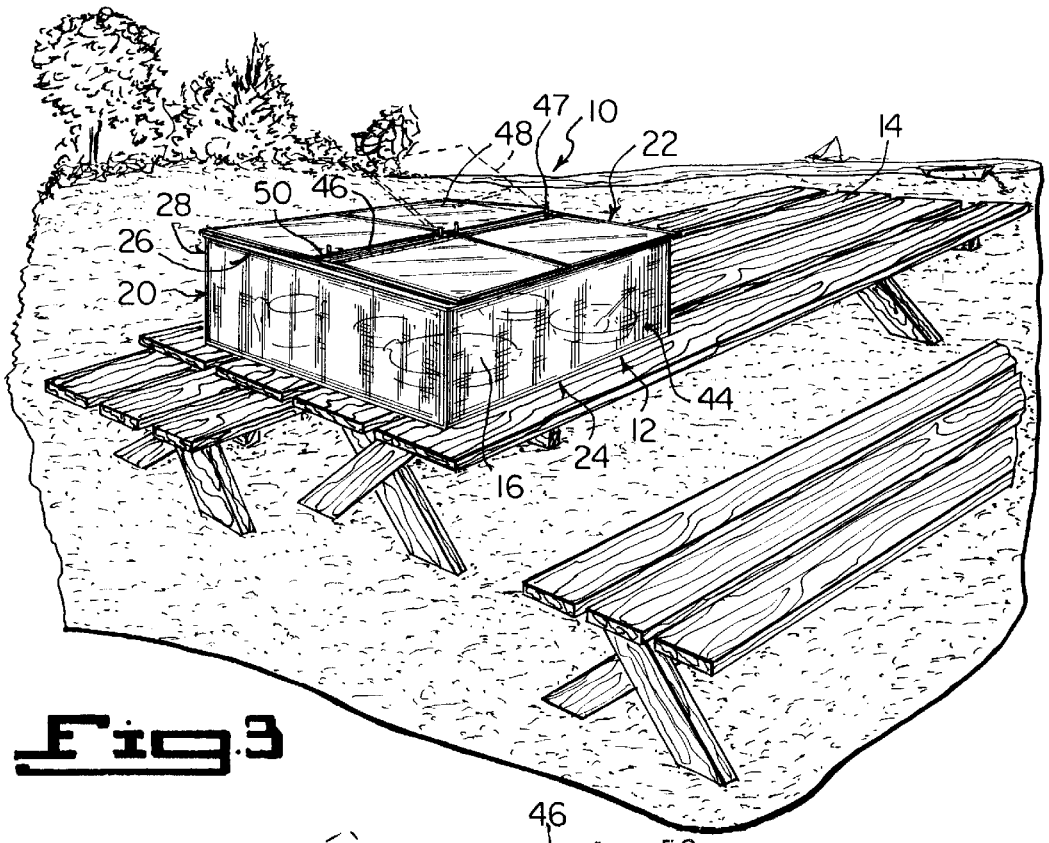
Fig.3
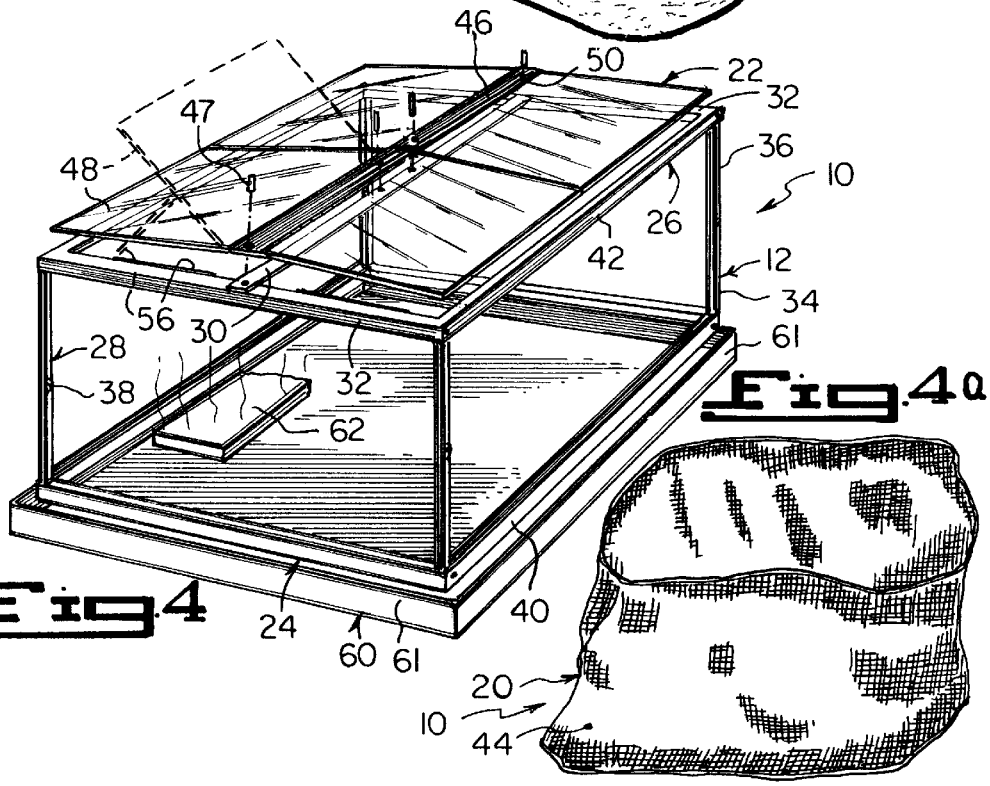
Fig.4a
Fig.4

FOOD ENCLOSURE

BACKGROUND OF THE INVENTION

1. Field of the Invention

The instant invention relates generally to screen supports and more specifically it relates to a food enclosure. The food enclosure is made of sturdy but lightweight wood, metal and netting materials, which is not easily harmed with careful use. At home, club house, in a trailer or apartment, the food enclosure in its carry case can be stored in a space slightly wider than a folded card table.

2. Description of the Prior Art

Numerous screen supports have been provided in prior art. For example, U.S. Pat. Nos. 976,950 to Tyner; 1,546,020 to Nesbitt; 3,744,500 to Briggs and 4,685,483 to Balazs all are illustrative of such prior art. While these units may be suitable for the particular purpose to which they address, they would not be as suitable for the purposes of the present invention as heretofore described.

TYNER, EVA

FOLDING FRAME FOR MOSQUITO BARS

U.S. Pat. No. 976,950

A device of the character described comprising two side members each formed from a piece of wire by bending it at suitable points to provide a central portion and depending legs. Inwardly folding end members are composed of half sections. Each of the latter being formed from a piece of wire bent into a U-form and having the extremities of its arms bent to form hinge eyes which engage the legs. A hinge strap unites the close portions of the two U-shaped half sections. A sliding catch for each end member is mounted for sliding movement on one half section of the same and has a channel portion to engage the opposing half section. Flexible elements are between the two side members.

NESBITT, LILLIAN C.

INSECT SCREEN FOR BEDS

U.S. Pat. No. 1,546,020

A protecting screen for beds comprising an upright back frame. Substantially triangular side frames are pivotally connected with the back frame and movable laterally to a folded position against the back frame. A canopy is fitted over the frames. An adjustable connection is between the reduced ends of the side frames. A means is for supporting the frames in position on a bed.

BRIGGS, ROBERT S.

SCREEN ENCLOSURE FOR PICNIC TABLES

U.S. Pat. No. 3,744,500

A foldable, portable, lightweight screen enclosure for picnic tables adjustable to fit tables of various lengths and widths. The enclosure framework has corner up rights with horizontally extending arms at their lower ends slideably receivable in horizontal tubular sockets in respective attachment members releasably clamped to the table corners. Horizontal members interconnecting the upper ends of the uprights are hinged at their respective ends and midpoints, permitting the framework structure to fold into a compact bundle of parallel frame elements.

BALAZS, MICHAEL A.

COLLAPSIBLE SUPPORT FOR FOOD SCREEN

U.S. Pat. No. 4,685,483

A collapsible frame assembly for supporting a tablecloth screen in a draped configuration over dishes on a hotel serving cart comprises a pair of elongate U-shaped base members and a pair of arcuate support members hingedly attached to the respective base members at midway points therealong. The support members are in turn hingedly attached to one another at ends opposite the ends at which the support members are attached to the base members. Each support member is rotatable through a ninety degree angle relative to the respective base member and through a one hundred eight degree angle relative to the other support member. In an open or unfolded configuration of the frame assembly, portions of the support members extend perpendicularly to the base members. In a folded or storage configuration the same portions of the support members extend substantially parallel to one another and to the base members.

SUMMARY OF THE INVENTION

The food enclosure is a functional, lightweight and portable food and beverage protector which, when easily assembled, sits atop a regular card table, a picnic table, park table, on a lanai, porch or patio table and folding banquet table. It can also be used at the beach, lake side, at a campsite or tailgating. Within the food enclosure, casseroles, serving dishes, beverage holders and picnic paraphernalia can be protected against nature, yet with very easy access.

A primary object of the present invention is to provide a food enclosure that will overcome the shortcomings of the prior art devices.

Another object is to provide a food enclosure that reduces, if not eliminates flies, gnats, wasps and other insects from nesting on exposed foods, dishes, tableware, serving utensils, etc., while due to its uniqueness, it grants entrance to items or foods through roof-top openings covered by a four door see-through plastic hinged canopy, permitting selective service.

An additional object is to provide a food enclosure that may be set up in the open, under trees or other overhangs, as the canopies shelter items and foods from falling leaves, small twigs or branches, wind-blown dust, dirt, droppings or other foreign objects, while it keeps all items and foods dry and protected from sudden rain showers requiring "hurry up" clean up.

A further object is to provide a food enclosure that is simple and easy to use.

A still further object is to provide a food enclosure that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 2:
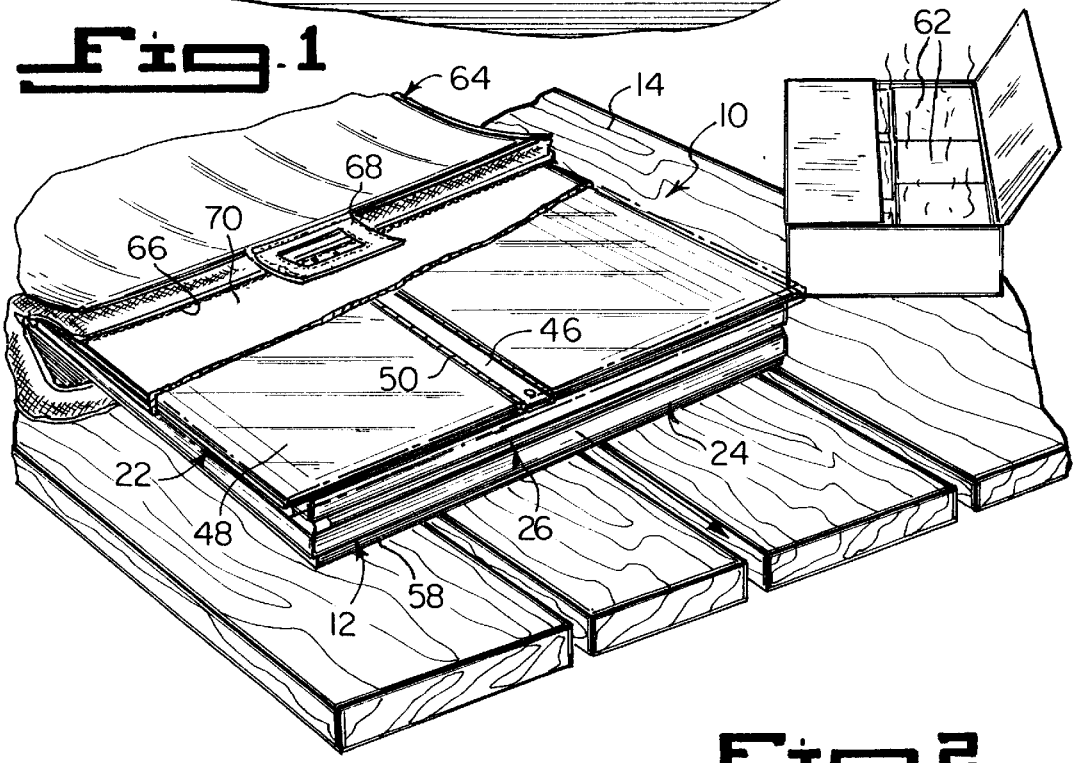
FIG. 2 is a perspective view, showing the carrying case broken away, placed upon a picnic table opened and the contents, which is the collapsed food enclosure being removed therefrom.
Figure 2A:
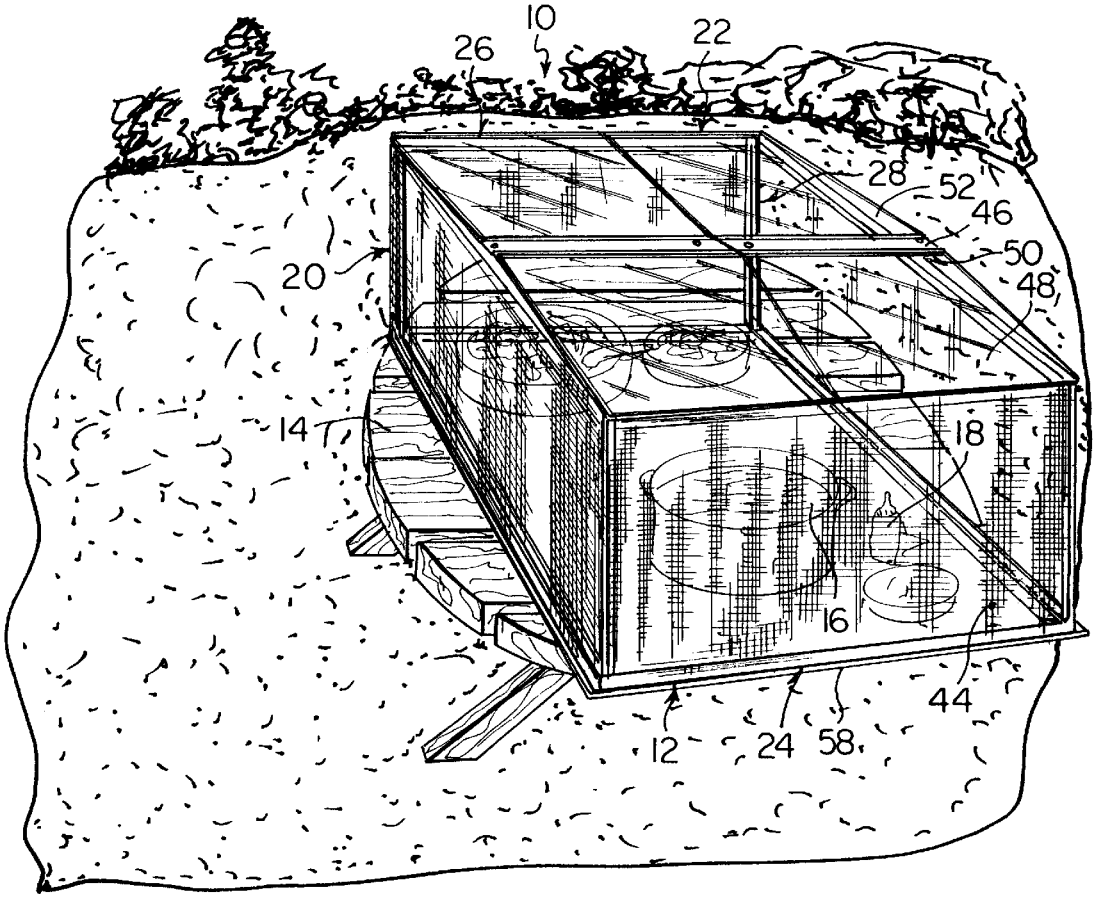

FIG. 2*a* is a perspective view of the food enclosure assembled upon a platform on a small round picnic table.

Figure 2B:
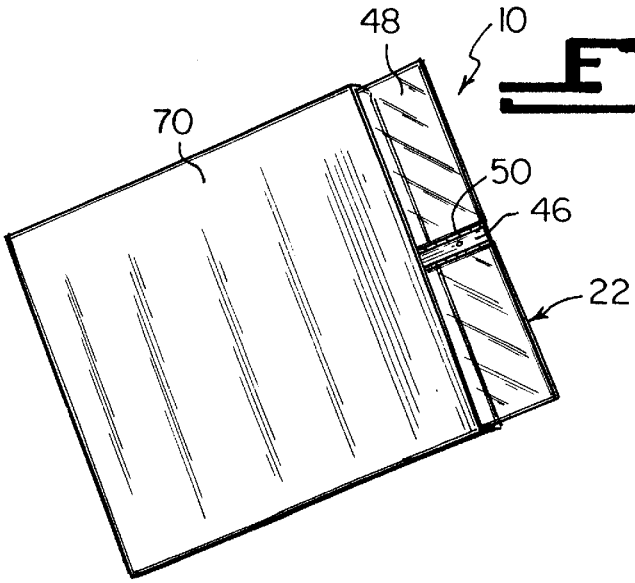

FIG. 2*b* is a perspective view, showing the canopy being removed from the protective sleeve.

FIG. 3 is a perspective view of the food enclosure assembled upon a large rectangular picnic table.

FIG. 4 is an exploded perspective view, showing the various components thereof being assembled together.

FIG. 4*a* is a perspective view of the screen skirt.

Figure 5:
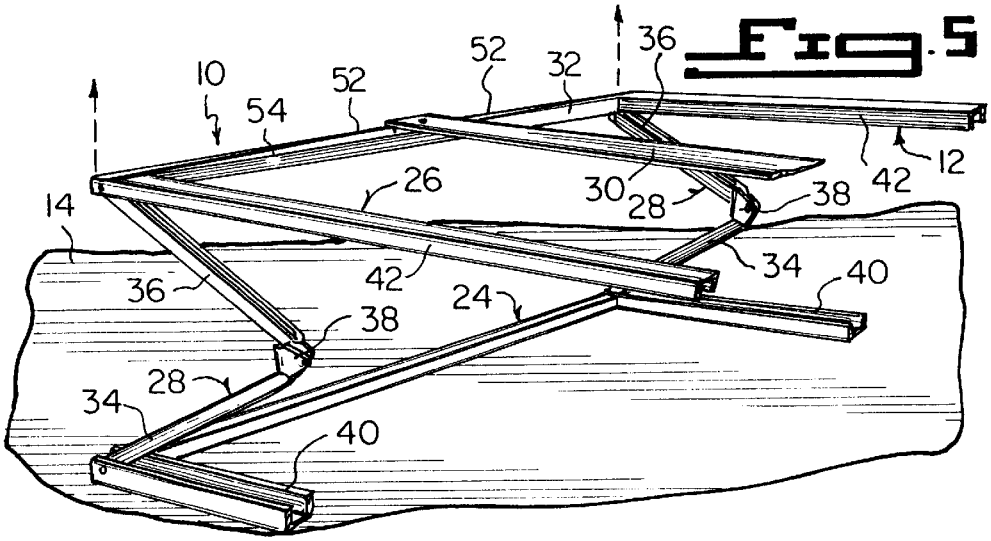

FIG. 5 is a partial perspective view, showing the framework going from a collapsed position into an extended position.

Figure 6:
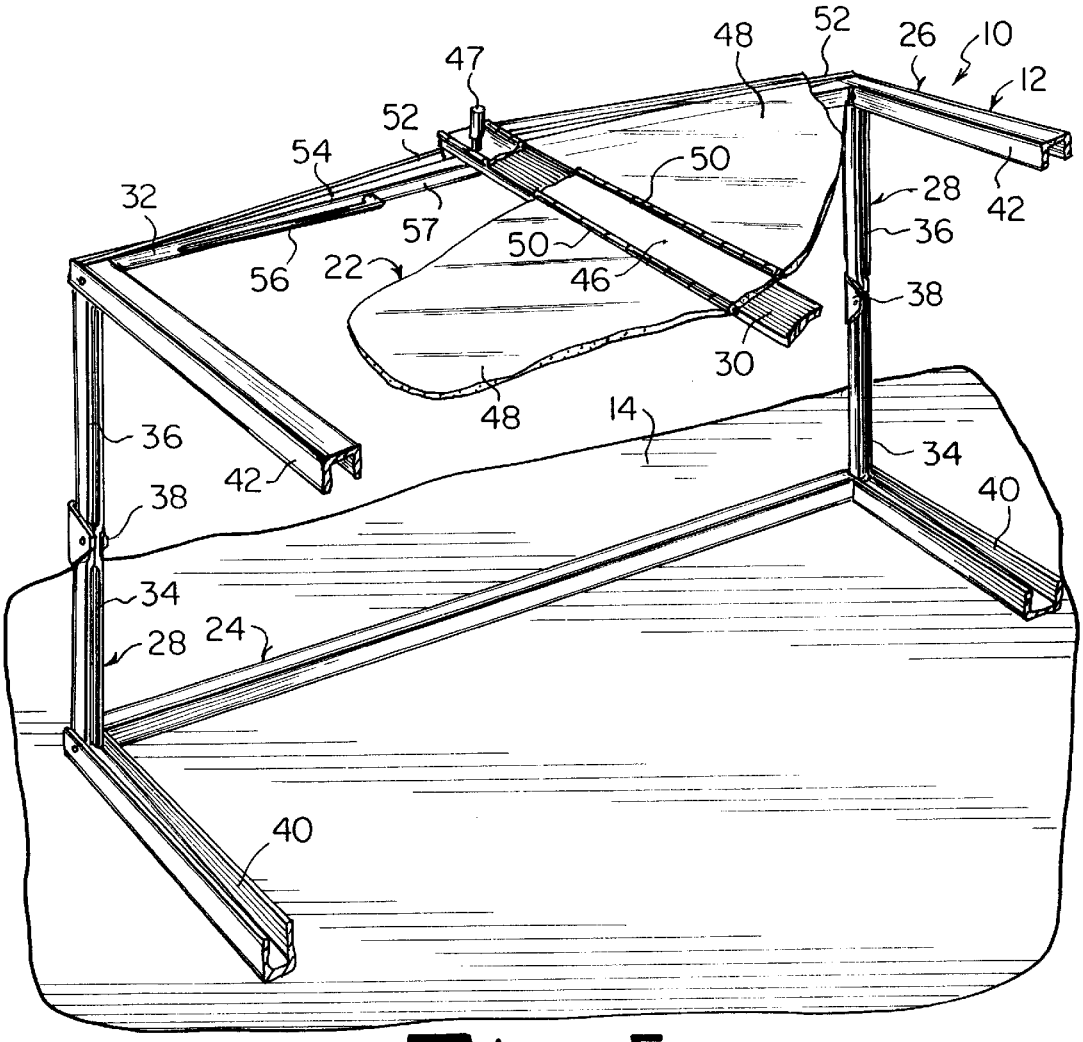

FIG. 6 is a partial perspective view, showing the framework in its extended position and the canopy broken away.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements throughout the several views, FIGS. 1 through 6 illustrate the present invention being a food enclosure 10. With regard to the reference numerals used, the following numbering is used throughout the various drawing figures.

| | |
|---|---|
| 10 | food enclosure |
| 12 | box-shaped framework of 10 |
| 14 | horizontal support surface |
| 16 | food |
| 18 | beverage |
| 20 | skirt of 10 about 12 |
| 22 | canopy of 10 on 12 |
| 24 | base frame portion of 12 |
| 26 | top frame portion of 12 |
| 28 | stanchion of 12 |
| 30 | center canopy support bar of 12 |
| 32 | end segment of 26 |
| 34 | lower leg of 28 |
| 36 | upper leg of 28 |
| 38 | joint stop member of 28 |
| 40 | side segment of 24 |
| 42 | side segment of 26 |
| 44 | elasticized netting material of 20 |
| 46 | center rib of 22 |
| 47 | mounting peg of 22 |
| 48 | see-through door of 22 |
| 50 | hinge of 22 |
| 52 | triangular shim |
| 54 | top surface of 32 |
| 56 | arm |
| 57 | inner side surface of 32 |
| 58 | platform of 10 |
| 60 | shallow tray of 10 |
| 61 | slightly turned up edges of 60 |
| 62 | sealed coolant container |
| 64 | carrying case of 10 |
| 66 | slide fastener mouth of 64 |

-continued

| | |
|---|---|
| 68 | handle of 64 |
| 70 | protective sleeve of 64 for 22 |
| 72 | trunk of 74 |
| 74 | motor vehicle |

The food enclosure 10 comprises a box-shaped framework 12 having two open sides, two open ends, and open top and an open bottom, which can be placed upon a horizontal support surface 14 over food 16 and beverages 18. A skirt 20 extends about the two open sides and the two open ends of the box-shaped framework 12. A canopy 22 is secured onto the open top of the box-shaped framework 12, to protect the food 16 and beverages 18 therein.

The box-shaped framework 12 includes a base frame portion 24, to rest upon the horizontal support surface 14 about the food 16 and beverages 18. A top frame portion 26 is provided for the canopy 22 to be mounted thereto. Four stanchions 28 are also provided. Each stanchion 28 extends vertically between each corner of the base frame portion 24 and the top frame portion 26. A center canopy support bar 30 extends horizontally between opposite end segments 32 of the top frame portion 26, to maintain the canopy 22 in a stabilized condition on the top frame portion 26.

Each stanchion 28 is foldable and includes a lower leg 34 pivoted at a bottom end to the corner of the base frame portion 24. An upper leg 36 is pivoted at a top end to the corner of the top frame portion 26. A joint stop member 38 is pivoted to both a top end of the lower leg 34 and a bottom end of the upper leg 36, to allow the box-shaped framework 12 to collapse for storage, bringing the top frame portion 26 down against the base frame portion 24.

The base frame portion 24 has two side segments 40 with a U-shaped cross section. The top frame portion 26 has two side segments 42 with an inverted U-shaped cross section. When the stanchions 28 go into their foldable positions, the lower legs 34 will fit into the side segments 40 of the base frame portion 24, while the upper legs 36 will fit into the side segments 42 of the top frame portion 26.

The skirt 20 is fabricated out of an elasticized netting material 44, which can be stretched to fit about the two open sides and the two open ends of the box-shaped framework 12. The canopy 22 is split into two sections and consists of a center rib 46 transversely divided into two halves and mounted with a plurality of pegs 47 onto the center canopy support bar 30. Four see-through doors 48 are provided. Two doors 48 are hinged oppositely at 50 to the first half of the center rib 46, while the other two doors 48 are hinged oppositely at 50 to the second half of the center rib 46. The doors 48 will cover the top frame portion 26 to protect the food 16 and beverages 18 therein, while allowing selective access to reach the food 16 and beverages 18.

As shown in FIGS. 5 and 6, the food enclosure 10 can further contain four triangular shims 52. Two of the triangular shims 52 are each mounted oppositely from the center canopy support bar 30 on a top surface 54 of a first end segment 32 of the top frame portion 26. The other two triangular shims 52 are each mounted oppositely from the center canopy support bar 30 on a top surface 54 of a second end segment 32 of the top frame portion 26, so as to compensate for the angular pitch of the four doors 48 of the canopy 22 on the top frame portion 26.

Four arms 56 can also be provided. Two of the arms 56 are each pivotally mounted oppositely from the center canopy support bar 30 on an inner side surface 57 of the first end segment 32 of the top frame portion 26. The other two arms 56 are each pivotally mounted oppositely from the center canopy support bar 30 on an inner side surface 57 of the second end segment 32 of the top frame portion 26, so that each arm 56 can pivot up to hold each respective door 48 in an open position.

FIG. 2*a* shows a platform 58 being of an equal size to the base frame portion 24, so that the box-shaped framework 12 can be placed upon a horizontal support surface 14 smaller in size than the base frame portion 24. FIG. 4 shows a shallow tray 60 having slightly turned up edges 61 and being slightly larger in size than the base frame portion 24. When the box-shaped framework 12 is placed upon the shallow tray 60 on the horizontal support surface 14, the shallow tray 60 will prevent the food enclosure 10 from sliding off of the horizontal support surface 14. A sealed coolant container 62, with dry ice or ice cubes therein can be put into the shallow tray 60 to keep the food 16 and beverages 18 cold if necessary.

Figure 1:
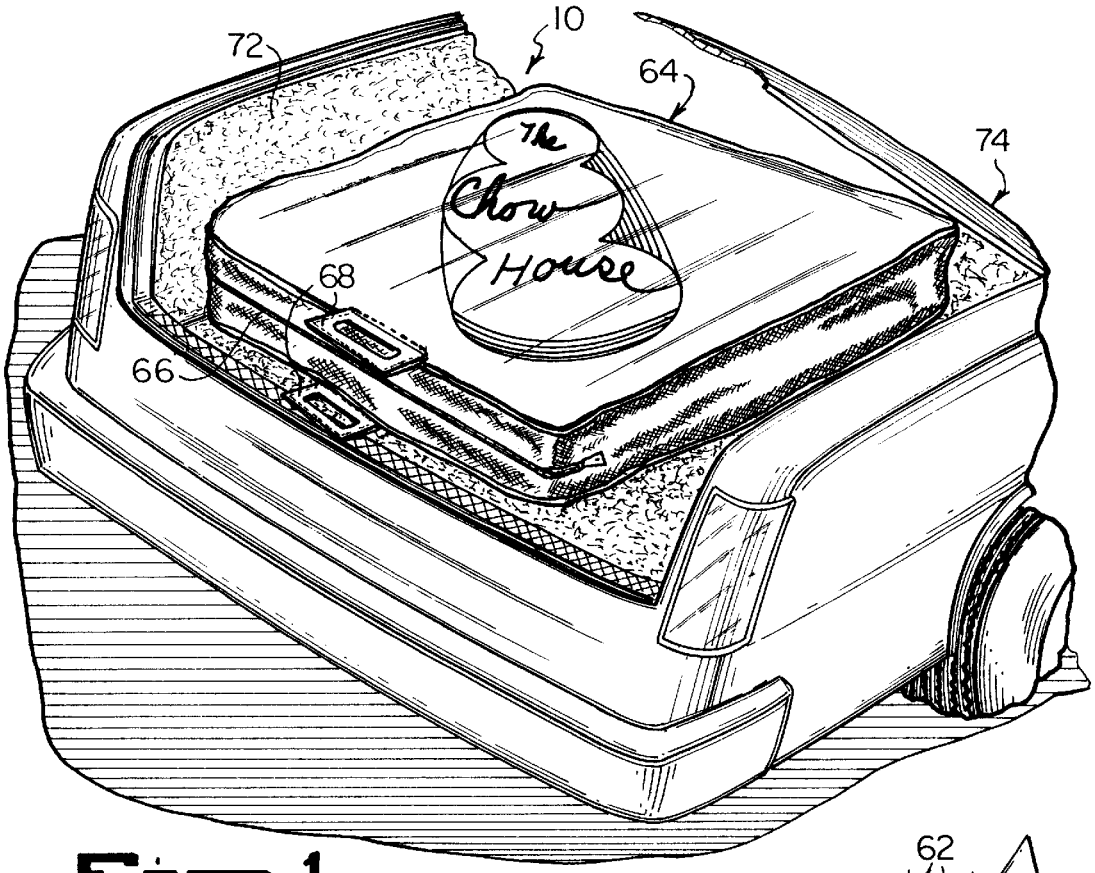
FIG. 1 is a perspective view, showing the carrying case storing the collapsed food enclosure, placed inside a trunk of a motor vehicle in which the motor vehicle is broken away.

As shown in FIGS. 1, 2 and 2*b*, the food enclosure 10 can further include a carrying case 64 with a slide fastener mouth 66 and a pair of handles 68 to receive the collapsed framework 12 and the skirt 20 therein. A protective sleeve 70 receives the canopy 22 therein. The protective sleeve 70 fits through the slide fastener mouth 66 and into the carrying case 64. The carrying case 64 can be placed into a trunk 72 of a motor vehicle 74 for storage and transportation thereof, as in FIG. 1.

The food enclosure 10, shown in FIG. 2*a*, is placed upon the horizontal support surface 14 of a small round picnic table. The food enclosure 10, shown in FIG. 3, is placed upon the horizontal support surface 14 of a large rectangular picnic table. Other types of horizontal support surfaces 14, not shown in the drawings, such as on a card table can also be utilized for maintaining the food enclosure 10. The food enclosure 10 can preferably be made in a square configuration to be used on the card table. It can also be made in a rectangular configuration, as shown in FIGS. 2*a*, 3 and 4.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A food enclosure comprising:

a) a box-shaped framework having two open sides, two open ends, an open top and an open bottom, which can be placed upon a horizontal support surface over food and beverages;

b) a skirt to extend about the two open sides and the two open ends of said box-shaped framework; and c) a canopy secured onto the open top of said box-shaped framework to protect the food and beverages therein wherein said box-shaped framework includes:

i) a base frame portion to rest upon said horizontal support surface about the food and beverages;

ii) a top frame portion for said canopy to be mounted thereto; and iii) four stanchions, in which each said stanchion extends vertically between each corner of said base frame portion and said top frame portion wherein each said stanchion is foldable and includes a lower leg pivoted at a bottom end to the corner of said base frame portion; an upper leg pivoted at a top end to the corner of said top frame portion; and a joint stop member pivoted to both a top end of said lower leg and a bottom end of said upper leg, to allow said box-shaped framework to collapse for storage bringing said top frame portion down against said base frame portion; and said base frame portion includes two side segments with a U-shaped cross section; and said top frame portion includes two side segments with an inverted U-shaped cross section, so that when said stanchions go into their foldable positions, said lower legs will fit into said side segments of said base frame portion, while said upper legs will fit into said side segments of said top frame portion.

2. A food enclosure as recited in claim 1, wherein said box-shaped framework further includes a center canopy support bar extending horizontally between opposite end segments of said top frame portion, to maintain said canopy in a stabilized condition on said top frame portion.

3. A food enclosure as recited in claim 1, wherein said skirt is fabricated out of an elasticized netting material which can be stretched to fit about the two open sides and the two open ends of said box-shaped framework.

4. A food enclosure as recited in claim 2, wherein said canopy is split into two sections and includes:

a) a center rib transversely divided into two halves and mounted onto said center canopy support bar; and b) four see-through doors, in which said two doors are hinged oppositely to the first half of said center rib, while said other two doors are hinged oppositely to the second half of said center rib, so that said doors will cover said top frame portion to protect the food and beverages therein, while allowing selective access to reach the food and beverages.

5. A food enclosure as recited in claim 4, further including four triangular shims, in which two of said triangular shims are each mounted oppositely from said center canopy support bar on a top surface of a first end segment of said top frame portion and said other two triangular shims are each mounted oppositely from said center canopy support bar on a top surface of a second end segment of said top frame portion, so as to compensate for the angular pitch of said four doors of said canopy on said top frame portion.

6. A food enclosure as recited in claim 4, further including four arms, in which two of said arms are each pivotally mounted oppositely from said center canopy support bar on an inner side surface of a first end segment of said top frame portion and said other two arms are each pivotally mounted oppositely from said center canopy support bar on an inner side surface of a second end segment of said top frame portion, so that each said arm can pivot up to hold each said respective door in an open position.

7. A food enclosure as recited in claim 1, further including a platform being of an equal size to said base frame portion, so that said box-shaped framework can be placed upon a horizontal support surface smaller in size than said base frame portion.

8. A food enclosure as recited in claim 1, further including a shallow tray having slightly turned up edges and being slightly larger in size than said base frame portion, so that when said box-shaped framework is placed upon said shallow tray on the horizontal support surface, said shallow tray will prevent said food enclosure from sliding off of the horizontal support surface.

9. A food enclosure as recited in claim 1, further including:

a) a carrying case with a slide fastener mouth and a pair of handles to receive said collapsed framework and said skirt therein; and b) a protective sleeve to receive said canopy therein, wherein said protective sleeve fits through said slide fastener mouth and into said carrying case.

10. A food enclosure as recited in claim 2, wherein said skirt is fabricated out of an elasticized netting material which can be stretched to fit about the two open sides and the two open ends of said box-shaped framework.

11. A food enclosure as recited in claim 10, wherein said canopy is split into two sections and includes:

a) a center rib transversely divided into two halves and mounted onto said center canopy support bar; and b) four see-through doors, in which said two doors are hinged oppositely to the first half of said center rib, while said other two doors are hinged oppositely to the second half of said center rib, so that said doors will cover said top frame portion to protect the food and beverages therein, while allowing selective access to reach the food and beverages.

12. A food enclosure as recited in claim 11, further including four triangular shims, in which two of said triangular shims are each mounted oppositely from said center canopy support bar on a top surface of a first end segment of said top frame portion and said other two triangular shims are each mounted oppositely from said center canopy support bar on a top surface of a second end segment of said top frame portion, so as to compensate for the angular pitch of said four doors of said canopy on said top frame portion.

13. A food enclosure as recited in claim 12, further including four arms, in which two of said arms are each pivotally mounted oppositely from said center canopy support bar on an inner side surface of a first end segment of said top frame portion and said other two arms are each pivotally mounted oppositely from said center canopy support bar on an inner side surface of a second end segment of said top frame portion, so that each said arm can pivot up to hold each said respective door in an open position.

14. A food enclosure as recited in claim 13, further including a platform being of an equal size to said base frame portion, so that said box-shaped framework can be placed upon a horizontal support surface smaller in size than said base frame portion.

15. A food enclosure as recited in claim 14, further including a shallow tray having slightly turned up edges and being slightly larger in size than said base frame portion, so that when said box-shaped framework is placed upon said shallow tray on the horizontal support surface, said shallow tray will prevent said food enclosure from sliding off of the horizontal support surface.

16. A food enclosure as recited in claim 15, further including:

a) a carrying case with a slide fastener mouth and a pair of handles to receive said collapsed framework and said skirt therein; and b) a protective sleeve to receive said canopy therein, wherein said protective sleeve fits through said slide fastener mouth and into said carrying case.

* * * * *